US007163423B1

(12) United States Patent
Peters et al.

(10) Patent No.: US 7,163,423 B1
(45) Date of Patent: Jan. 16, 2007

(54) COAXIAL SYSTEM WITH KEYING FEATURE

(75) Inventors: Jeffrey Louis Peters, Eagan, MN (US); David J. Johnsen, Plymouth, MN (US); Kenneth Allen Skluzacek, Belle Plaine, MN (US); Duane R. Sand, Annandale, MN (US); M'hamed Anis Khemakhem, Eden Prairie, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 11/408,588

(22) Filed: Apr. 21, 2006

(51) Int. Cl.
*H01R 13/64* (2006.01)

(52) U.S. Cl. ..... 439/680; 439/677; 439/540.1; 439/188

(58) Field of Classification Search ..... 439/680, 439/674, 677, 540.1, 668, 669, 188
See application file for complete search history.

(56) References Cited

U.S. PATENT DOCUMENTS 3,351,892 A * 11/1967 Coover ..... 439/677
5,266,042 A * 11/1993 Hampel ..... 439/188
5,885,096 A 3/1999 Ogren
5,938,478 A * 8/1999 Werner ..... 439/668

OTHER PUBLICATIONS

ADC Telecommunications, Inc. "Video Products—CAPS Component Patching System," p. 20 of Catalog (1 page), May 2000.

* cited by examiner

*Primary Examiner*—Tho D. Ta
(74) *Attorney, Agent, or Firm*—Merchant & Gould P.C.

(57) ABSTRACT

A keying system to control a mating interface between a plurality of mating jacks and plugs in a coaxial telecommunications panel.

16 Claims, 6 Drawing Sheets

COAXIAL SYSTEM WITH KEYING FEATURE

FIELD

This invention pertains to the telecommunications industry. More particularly, this invention pertains to coaxial jacks and plugs with a keying feature to correctly route the signals.

BACKGROUND

Coaxial jacks and plugs are used to route and manage coaxial signals. Multiple jacks can be organized in panels. The panels are typically labeled to distinguish the jacks from one another. However, when the jacks and the plugs can be used interchangeably, there is a possibility that a plug will be inserted into an incorrect jack.

High definition video broadcast standard uses dual coaxial lines to carry the complete signal. For example, one coaxial line carries an "A" signal while the other coaxial line carries a different "B" signal. While routing the high definition signal with a dual port plug, it is important to insert the dual port plug in the correct orientation into a telecommunications equipment such as a coaxial jack panel so that the dual coaxial high definition lines are correctly matched up and routed through the system. A keying feature is desirable to correctly orient the dual port plug to correctly route the dual high definition video signals.

SUMMARY

The present invention relates to a coaxial system with a keying feature to allow correct mating of coaxial jacks and plugs to correctly route signals. In one embodiment, a panel includes a plurality of jacks, where the jacks include a mating interface feature that only allows certain plugs to be mated. The plugs are paired to form a dual plug where the dual plug can only be mated with the jacks when the dual plug is in the proper orientation with respect to the mating jacks.

BRIEF DESCRIPTION OF THE DRAWINGS

The accompanying drawings, which are incorporated in and constitute a part of the specification, illustrate several aspects of the present invention and together with the description, serve to explain the principles of the invention. A brief description of the drawings is as follows.

DETAILED DESCRIPTION

Reference will now be made in detail to the exemplary aspects of the present invention that are illustrated in the accompanying drawings. Wherever possible, the same reference numbers will be used throughout the drawings to refer to the same or like parts.

Figure 1:
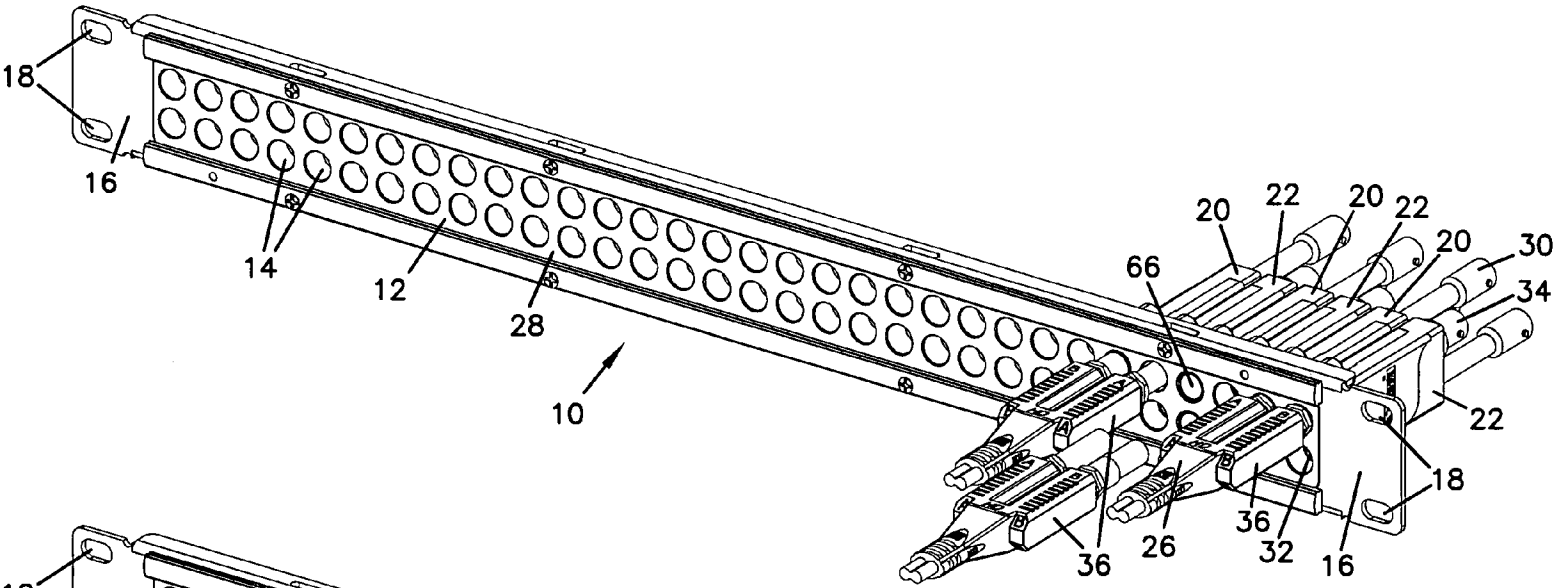
FIG. 1 is a front perspective view of a telecommunications panel according to the present invention, the panel illustrated with a plurality of coaxial jacks mounted to a rear of a frame of the panel and a plurality of dual port plugs mounted to a front of the frame of the panel, one of the dual port plugs shown inserted into the frame in the correct orientation, one of the dual port plugs shown inserted into the frame in the incorrect orientation, and one of the plugs shown prior to insertion.
Figure 2:
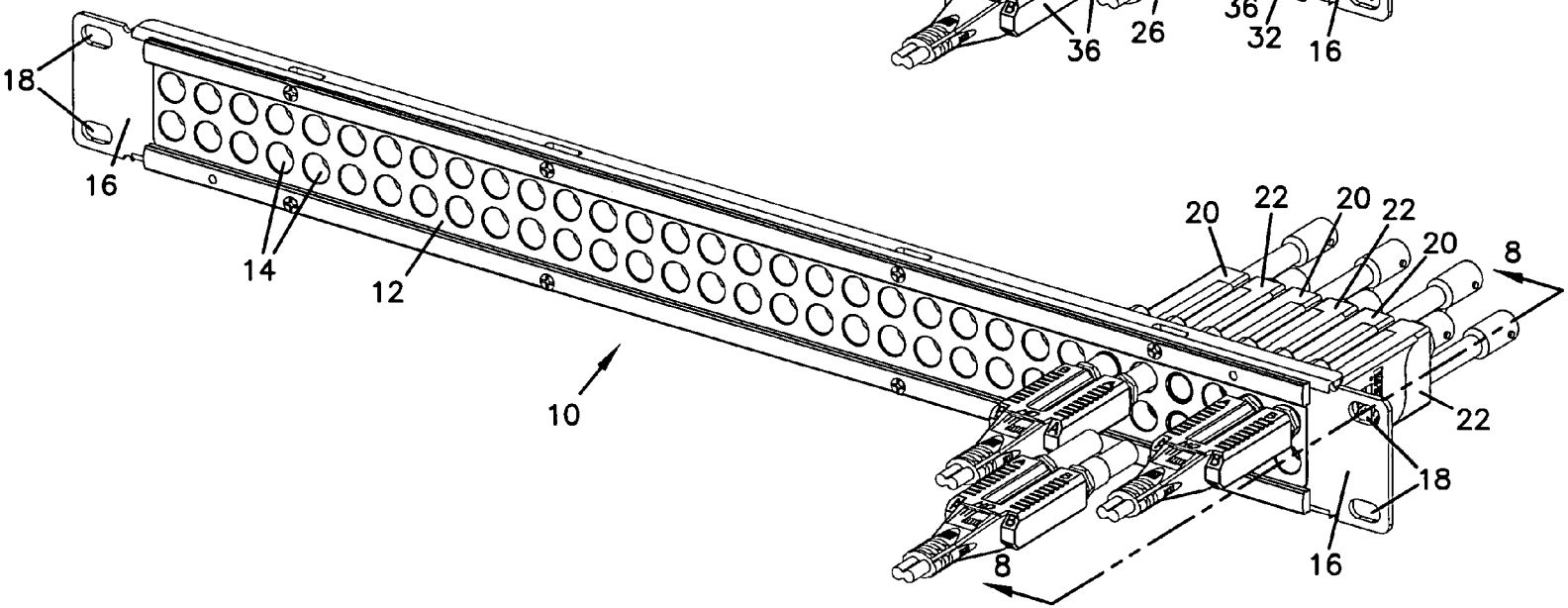
FIG. 2 is a front perspective view of the telecommunications panel of FIG. 1, illustrating the uncoupled dual port plug of FIG. 1 correctly inserted into the frame of the panel.

FIGS. 1–2 illustrate a front perspective view of a panel 10 according to the invention. Panels 10 such as shown in FIGS. 1–2 might be installed in broadcast communications production facilities. Panel 10 includes a frame 12 with a plurality of openings 14. Frame 12 includes a pair of opposing mounting flanges 16 on sides of frame 12 to facilitate mounting panel 10 to a communications equipment rack or other mounting structure in broadcast facility. Flanges 16 include openings 18 for receiving fasteners to secure panel 10 to the rack or other mounting structure.

Panel 10 is shown in FIGS. 1–2 with first coaxial jacks 20 and second coaxial jacks 22 mounted to a rear side 24 of frame 12. First coaxial jacks 20 include a set of front connectors or ports 26, accessible through openings 14 from a front side 28 of frame 12 and a set of rear connectors or ports 30, accessible from a rear side 24 of frame 12. Second coaxial jacks 22 also include a set of front connectors or ports 32, accessible through openings 14 from front side 28 of frame 12 and a set of rear connectors or ports 34, accessible from rear side 24 of frame 12. First coaxial jacks 20 and second coaxial jacks 22 are mounted to frame 12 in an alternating fashion. First coaxial jacks 20 are used for routing a first signal, for example, a signal "A", and second coaxial jacks 22 are used for routing a different second signal, for example, a signal "B".

First and second coaxial jacks 20, 22 may include normal through switching type jacks. In other embodiments, first and second coaxial 20, 22 jacks may include straight through (non-switching) jacks or other types of jacks. Switching type jacks provide internal circuitry so that without a plug inserted within either of the front connectors, an electrical path is defined between the pair of rear connectors. No such circuitry is provided in straight through jacks. U.S. Pat. No. 5,885,096, the disclosure of which is incorporated herein by reference, discloses a switching jack similar to first and second coaxial switching jacks 20, 22 depicted in FIGS. 1–2 and 7–12 of the present disclosure.

Figure 3:
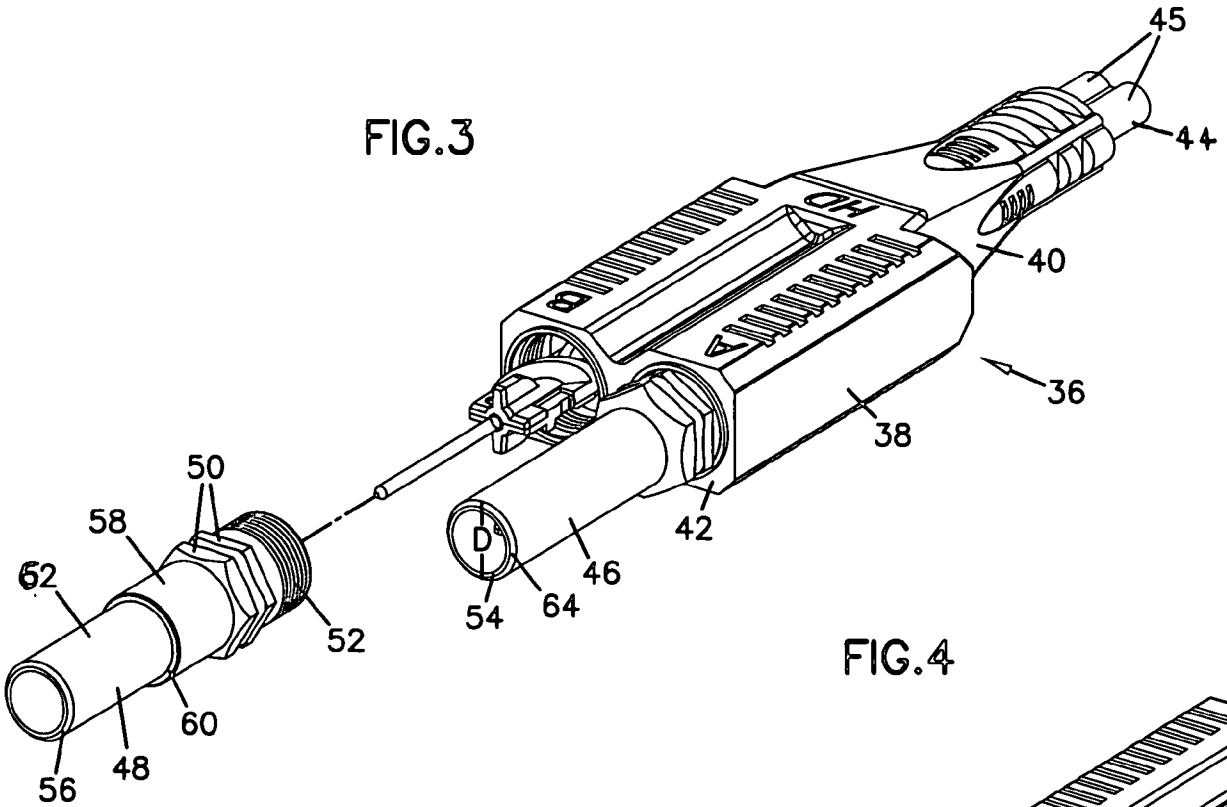
FIG. 3 is a partially exploded perspective view of a dual port plug according to the invention.
Figure 4:
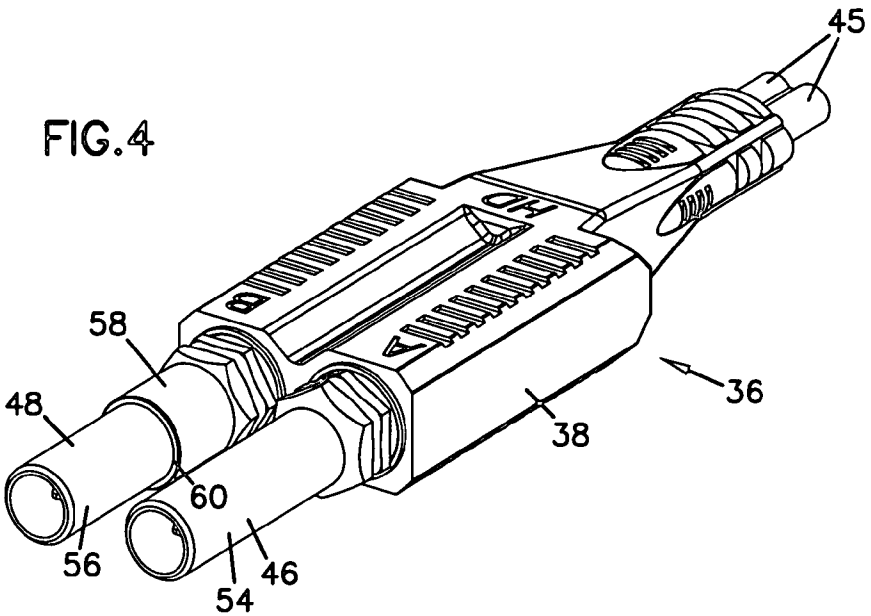
FIG. 4 is a perspective view of the dual port plug of FIG. 3, illustrated in an assembled configuration.
Figure 5:
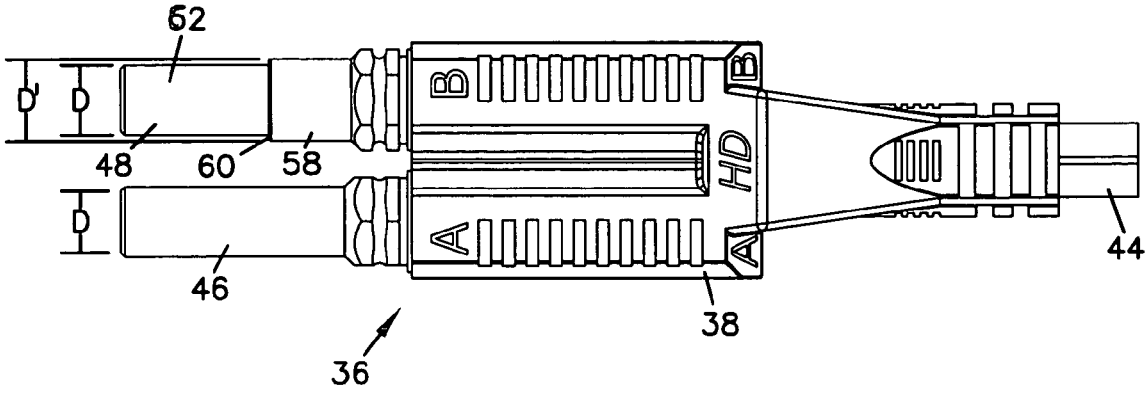
FIG. 5 is a top plan view of the dual port plug of FIG. 3.
Figure 6:
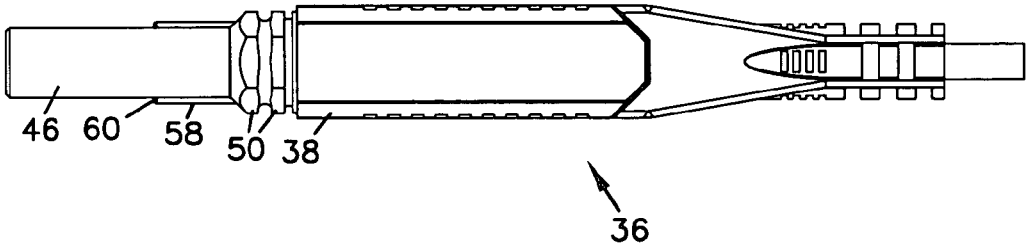
FIG. 6 is a side elevational view of the dual port plug of FIG. 3.

Still referring to FIGS. 1–2, panel 10 is also shown with dual port plugs 36 coupled to first and second coaxial jacks 20, 22 through frame 12. Dual port plugs 36 are illustrated in FIGS. 3–6. Each dual port plug 36 is configured to carry two broadcast signals and patch these signals simultaneously. For example, as depicted in FIG. 3, each dual port plug 36 carries an "A" signal and a different "B" signal. When coupling dual port plugs 36 with coaxial jacks 20, 22, as shown in FIGS. 1–2, it becomes important to orient plugs 36 correctly with respect to coaxial jacks 20, 22 such that the port carrying the "A" signal is inserted into front connectors 26 of first coaxial jacks 20 routing the "A" signal and the port carrying the "B" signal is inserted into front connectors 32 of second coaxial jacks 22 routing the "B" signal. As will be discussed in further detail below, dual port plug 36 and first and second coaxial jacks 20, 22 cooperatively form a keying arrangement to ensure that the correct ports are inserted into the correct front connectors.

Referring to FIGS. 3–6, each dual port plug 36 includes a plug body 38 with a first end 40 and a second end 42. Extending from first end 40 is a dual signal cable 44. Cable 44 includes two wires 45. Extending from second end 42 are a first plug barrel 46 and a second plug barrel 48. Plug barrels 46, 48 are threadingly coupled to plug body 38. Flats 50 are defined adjacent threads 52 to facilitate fastening and removing of barrels 46, 48 from plug body 38. Opposite the end with threads 52 are connection ends 54 and 56 of first plug barrel 46 and second plug barrel 48, respectively. Connection ends 54, 56 of first and second plug barrels 46, 48 are configured to be inserted within openings 14 defined on frame 12 to mate with front coaxial jack connectors 26, 32. Plug body 38 includes an inner conductive body portion, and an outer non-conductive body portion.

Connection end 54 of the first plug barrel 46 includes a generally cylindrical shape with a uniform diameter D. Connection end 56 of second plug barrel 48 also includes a generally cylindrical shape. However, connection end 56 of second plug barrel 48 includes a larger diameter portion 58 with a diameter D' that defines a shoulder 60 with a smaller diameter portion 62 that includes a diameter D similar in size to diameter D of connection end 54 of first plug barrel 46 (see FIGS. 5 and 6). Shoulder 60 forms a keying feature to provide for correct orientation of plug 36 for insertion into coaxial jacks 20, 22 of panel 10.

Figure 7:
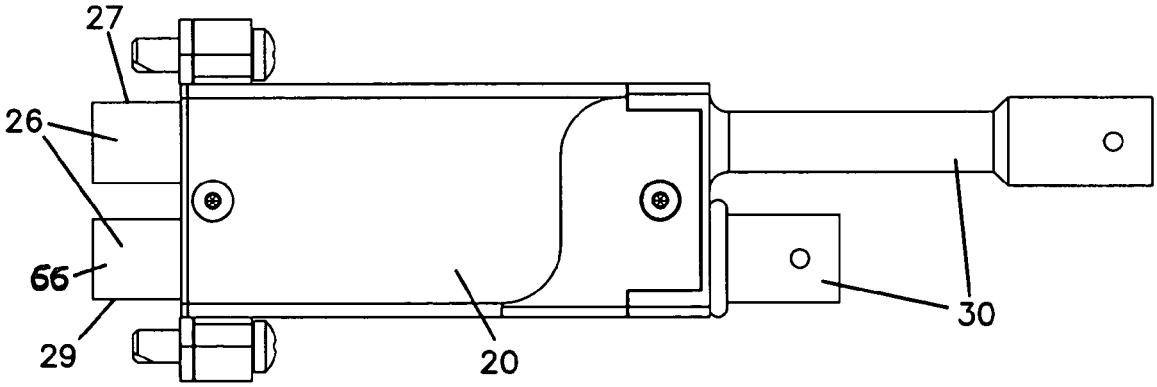
FIG. 7 is a side elevational view of a coaxial switching jack for routing a first type of signal according to the invention.
Figure 8:
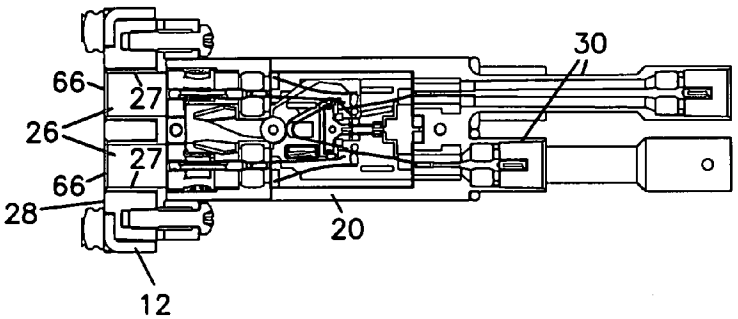
FIG. 8 is a cross-sectional view of the coaxial switching jack of FIG. 7 coupled to the frame of FIG. 1, the cross-sectional view taken along a line similar to line 8—8 of FIG. 2.

FIG. 7 illustrates a side view of one of first coaxial jacks 20 used for routing signal "A". FIG. 8 illustrates a cross-sectional view of a first coaxial jack 20 inserted into frame 12. As shown in FIG. 8, the barrels 27 of front connectors 26 lie flush with front side 28 of frame 12.

Figure 10:
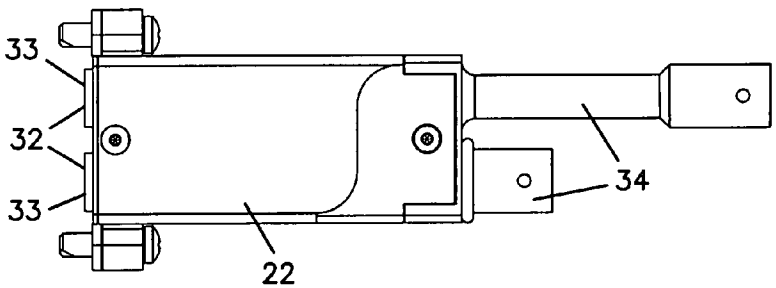
FIG. 10 is a side elevational view of a coaxial switching jack for routing a second type of signal according to the invention.
Figure 11:
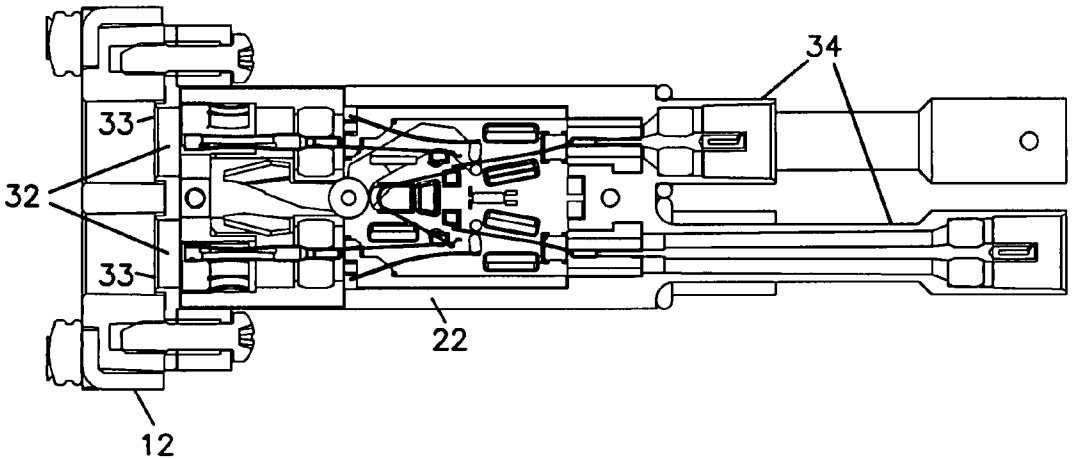
FIG. 11 is a cross-sectional view of the coaxial switching jack of FIG. 10 coupled to the frame of FIG. 1, the cross-sectional view taken along a line similar to line 8—8 of FIG. 2.

FIG. 10 illustrates a side view of one of second coaxial jacks 22 used for routing signal "B". Front connectors 32 of second coaxial jacks 22 have a length L that is shorter than front connectors 26 of first coaxial jacks 20. FIG. 11 illustrates a cross-sectional view of a second coaxial jack 22 inserted into frame 12. As shown in FIG. 11, the barrels 33 front connectors 32 of second coaxial jack 22 are set back from front side 28 of frame 12.

Figure 9:
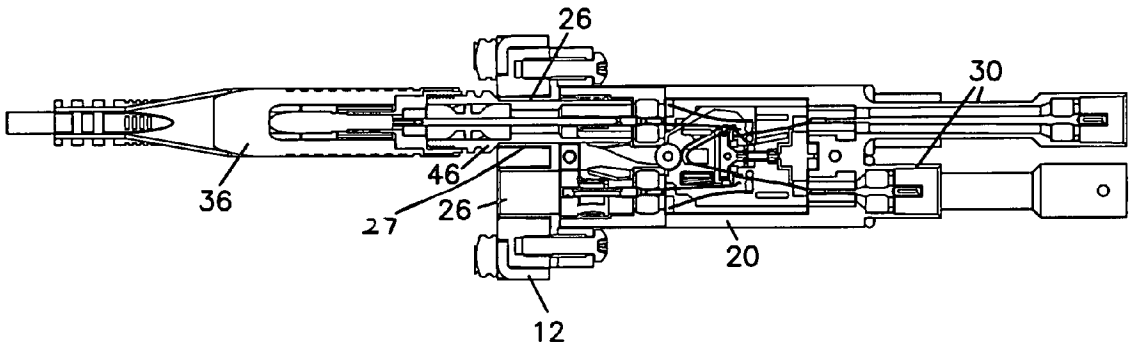
FIG. 9 is a cross-sectional view of the coaxial switching jack of FIG. 7 and the dual port plug of FIG. 3 coupled to the frame of FIG. 1, the cross-sectional view taken along a line similar to the line 8—8 of FIG. 2.
Figure 12:
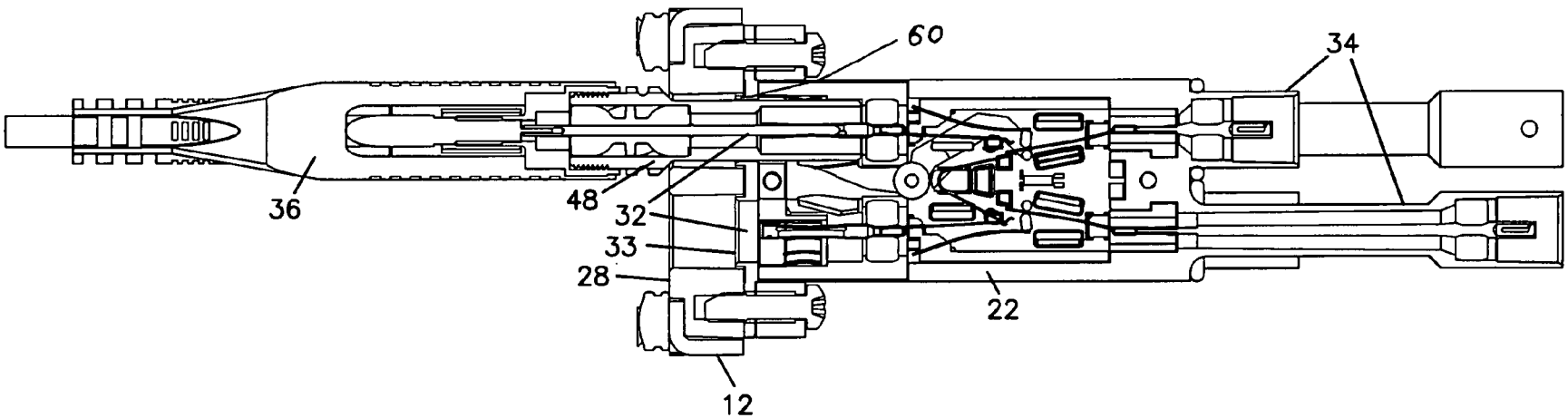
FIG. 12 is a cross-sectional view of the coaxial switching jack of FIG. 10 and the dual port plug of FIG. 3 coupled to the frame of FIG. 1, the cross-sectional view taken along a line similar to the line 8—8 of FIG. 2.

Referring now to FIGS. 9 and 12, the keying feature of dual plug 36 and coaxial jacks 20, 22 is illustrated. As shown in FIG. 9, first plug barrels 46 are fully insertable into front connectors 26 of first coaxial jacks 20 since diameter D of first plug barrels 20 are small enough to fit within front connectors 26. As shown in FIG. 12, second plug barrels 48 are fully insertable into front connectors 32 of second coaxial jacks 22 since front connectors 32 of second coaxial jacks 22 are set back to accommodate larger diameter portions 58 defining shoulders 60.

Figure 13:
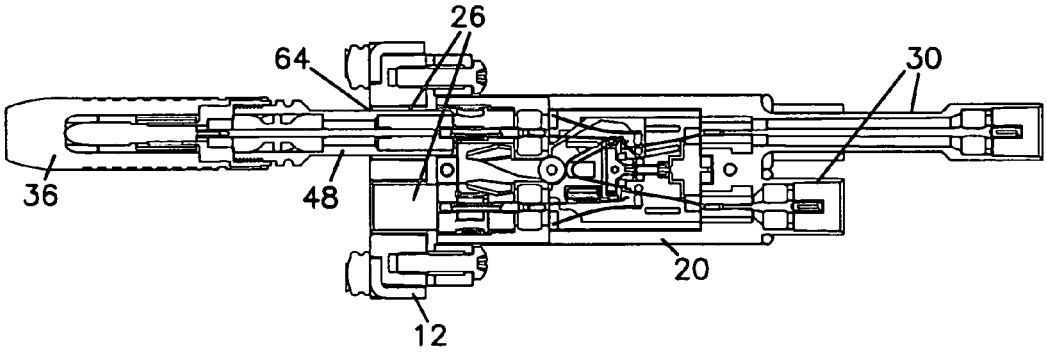
FIG. 13 is a cross-sectional view of the coaxial switching jack of FIG. 7 and the dual port plug of FIG. 3 incorrectly coupled, the cross-sectional view taken along a line similar to the line 8—8 of FIG. 2.

On the other hand, if plug 36 was flipped 180 degrees and second plug barrels 48 were to be inserted into front connectors 26 of first coaxial jacks 20, second plug barrels 48 would only be able to extend part way into front connectors 26 since shoulder 60 would abut against front connector walls 64 lying flush with front side 28 of frame 12 (see FIG. 13). Shoulder 60 includes about the same size diameter as opening 66 defined by front connectors 26 of first coaxial jacks 20 and thus is able to prevent insertion of second plug barrels 48 past a certain predetermined point into front connectors 26 of first coaxial jacks 20.

In this manner, as shown in FIG. 1, when dual plug 36 is oriented and inserted incorrectly, connection ends 54, 56 of the first and second plug barrels 46, 48 cannot be fully inserted into front connectors 32, 26 of second and first coaxial jacks 22, 20, respectively, and end up protruding out partially from frame 12. As shown in FIG. 1, when dual plug 36 is oriented correctly, plug barrels 46, 48 are fully insertable into front connectors 26, 32 of coaxial jacks 20, 22.

Shoulder 60 defined by larger diameter portion 58 of second plug barrel 48 is located such that second plug barrel 48 cannot be inserted into front connector 26 of first coaxial jack 20 past a predetermined point or a predetermined distance, as neither can first plug barrel 46. For example, in one embodiment, wherein first coaxial jack 20 is a switching type jack, the predetermined distance is such that insertion of second plug barrel 48 incorrectly will not actuate levers 68 to break the normal through routing. In other embodiments, for example, wherein first coaxial jack 20 might be a straight through jack, the predetermined distance could be such that insertion of second plug barrel 48 incorrectly will still prevent either of plug barrels 46, 48 from extending far enough into the front connectors to cross the signals, causing a disruption of service.

Thus, in the preferred embodiment, the combination of first and second plug barrels 46, 48 and first and second coaxial jacks 20, 22 and frame 12 serves a dual purpose. First, the features prevent incorrect orientation of dual plug 36 with respect to coaxial jacks 20, 22 of panel 10. Second, even if dual plug 36 is oriented and inserted incorrectly into front connectors 26, 32, of coaxial jacks 20, 22, the features prevent breaking normal-through routing in the case of switching jacks or prevents disruption of service in the case of straight through jacks.

It should be noted that the high definition video broadcast industry is only one of many different industries utilizing simultaneous dual signal patching. The keying feature formed from the combination of first and second plug barrels 46, 48 and first and second coaxial jacks 20, 22 and frame 12 is not limited to high definition video broadcasting and can be used in other applications using dual signal patching and other signal patching where there is a desire to prevent certain plugs and jacks from being mated.

Figure 14:
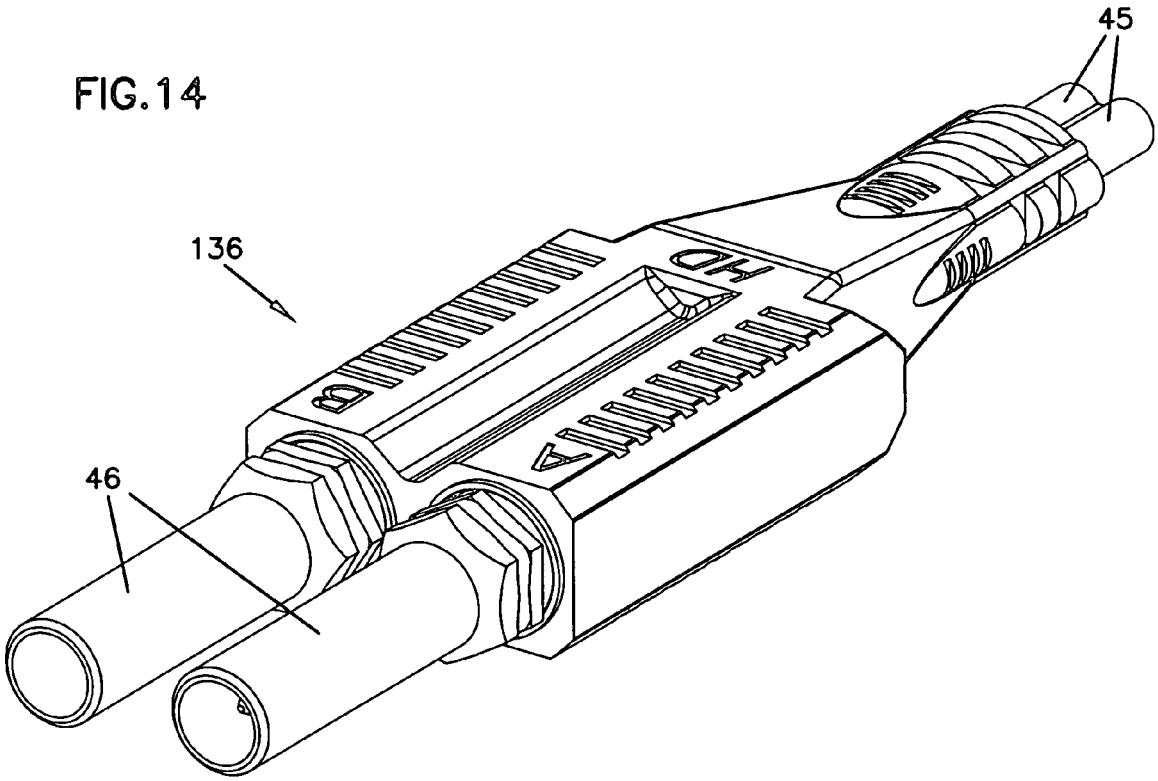
FIG. 14 is a perspective view of a dual port plug with identical plug barrels.

If desired, plug 36 can be constructed with identical plug barrels 46 as shown in FIG. 14 for plug 136. Plug 136 can be used with a jack panel like panel 10. However, plug 136 will be insertable in either orientation. Plug 136 is not a keyed component. Plug 136 can be changed to a keyed plug 36 by changing the "B" barrel 46 to a "B" barrel 48. Plugs 36, 136 can include indicia molded into plug body 38 for the "A" and "B" signal lines.

The above specification, examples and data provide a complete description of the manufacture and use of the invention. Since many embodiments of the invention can be made without departing from the spirit and scope of the invention, the invention resides in the claims hereinafter appended.

What is claimed is:

1. A coaxial telecommunications panel comprising:

a frame including a front side and a rear side and defining a plurality of openings;

a first coaxial jack including a front connector and a rear connector, the first coaxial jack mounted to the frame with the front connector inserted into one of the plurality of openings of the frame with the front connector accessible from the front side of the frame;

a second coaxial jack including a front connector and a rear connector, the front connector of the second coaxial jack defining a different configuration from the front connector of the first coaxial jack, the second coaxial jack mounted to the frame adjacent the first coaxial jack with the front connector inserted into one of the plurality of openings of the frame with the front connector accessible from the front side of the frame; and a dual plug including a cable end and a connection end opposite the cable end, the connection end including a first coaxial plug and a second coaxial plug, the dual plug configured to be plugged into the frame through the plurality of openings, the second coaxial plug including a different configuration from the first coaxial plug such that the second coaxial plug is only correctly coupleable with the front connector of the second coaxial jack through the frame and the first coaxial plug is only correctly coupleable with the front connector of the first coaxial jack through the frame;

wherein the front connector of the second coaxial jack defines a shorter length than the front connector of the first coaxial jack.

2. A coaxial telecommunications panel according to claim 1, wherein, if the second coaxial plug is coupled to the front connector of the first coaxial jack, the dual plug is not fully insertable into the frame to couple the dual plug to the panel.

3. A coaxial telecommunications panel according to claim 1, wherein the second coaxial plug defines a portion with a larger diameter than the first coaxial plug.

4. A coaxial telecommunications panel according to claim 1, wherein the front connector of the first coaxial jack lies generally flush with the front side of the frame when the first coaxial jack is mounted thereon and the front connector of the second coaxial jack is set back from the front side of the frame when the second coaxial jack is mounted thereon to accommodate the second coaxial plug wherein the front connector of the first coaxial jack cannot fully accommodate the second coaxial plug.

5. A coaxial telecommunications panel according to claim 1, wherein the dual plug routes a different signal through the first coaxial plug than through the second coaxial plug.

6. A coaxial telecommunications panel according to claim 1, wherein the first and second coaxial jacks are mounted to the frame in a side-by-side configuration.

7. A coaxial telecommunications panel according to claim 1, wherein the first and second coaxial jacks are switching type coaxial jacks.

8. A coaxial telecommunications panel according to claim 7, wherein if the second coaxial plug is incorrectly coupled into the front connector of the first coaxial jack, a switch mechanism of the first coaxial jack is not triggered.

9. A coaxial telecommunications panel according to claim 7, wherein the first and second coaxial jacks are mounted in the frame in a side-by-side configuration to form a jack pair, wherein a plurality of jack pairs and a plurality of the dual plugs are provided.

10. A coaxial telecommunications assembly comprising:

a first coaxial jack including a front connector defining a first exterior shape;

a second coaxial jack including a front connector defining a second exterior shape that is different than the first exterior shape; and a plug including a first mating coaxial connector and a second mating coaxial connector, the plug configured for insertion into both the first coaxial jack and the second coaxial jack to simultaneously route a first signal through the first coaxial jack and route a second signal through the second coaxial jack, wherein the second mating coaxial connector defines a different shaped interface than the first mating coaxial connector such that the second mating coaxial connector is only fully insertable into the front connector of the second coaxial jack and is not fully insertable into the front connector of the first coaxial jack to correctly align the plug with respect to the first and second coaxial jacks to correctly route the first and second signals;

wherein the front connector of the second coaxial jack defines a shorter length than the front connector of the first coaxial jack.

11. A coaxial telecommunications assembly according to claim 10, wherein the first and second coaxial jacks are switching type jacks and wherein if the second mating coaxial connector is incorrectly inserted into the front connector of the first coaxial jack, a switch mechanism of the first coaxial jack is not triggered.

12. A coaxial telecommunications assembly according to claim 10, wherein the second mating coaxial connector defines a portion with a larger diameter than the first mating coaxial connector.

13. A telecommunications plug comprising:

a body with a first end and a second end, extending from the first end is a dual signal cable and extending from the second end is a first barrel carrying a first telecommunications signal and a second barrel carrying a second telecommunications signal;

the first barrel including a generally cylindrical shape with a uniform diameter extending from a connection end of the first barrel to the body; and the second barrel including a generally cylindrical shape with a first diameter portion extending from a connection end of the second barrel to a second larger diameter portion, the larger diameter portion defining a shoulder with the first diameter portion, the first diameter portion having a diameter similar in size to the diameter of the first barrel.

14. The telecommunications plug according to claim 13, wherein the first and second barrels are each threadably mounted to a conductive body portion wherein a non-conductive housing surrounds the conductive body portion.

15. The telecommunications plug according to claim 13, wherein the body includes indicia for each of the first and second barrels including the letters “A” and “B”.

16. A coaxial telecommunications panel comprising:

a frame including a front side, a rear side, and two ends, the two ends including openings for mounting to a mounting structure;

a plurality of first jacks mounted to the frame adjacent to the rear side, each of the first jacks having a front port defined by a first barrel, and a rear port;

a plurality of second jacks mounted to the frame adjacent to the rear side, each of the second jacks having a front port defined by a second barrel, and a rear port, the second barrel longer than the first barrel, each of the first and second barrels accessible from the front side of the frame;

wherein the first and second jacks alternate to form jack pairs along the frame between the two ends;

a plurality of plugs, each plug including a cable end and a connection end opposite the cable end, the connection end including first and second posts, the posts extending to distal ends, the first post having an enlarged portion, wherein each plug is matable with one of the jack pairs;

wherein when the first post of each plug is aligned with the first barrel of the jack pair, and the second post of each plug is aligned with the second barrel of the jack pair, each plug is fully insertable into the respective jack pair;

wherein when the first post of each plug is aligned with the second barrel of the jack pair, and the second post of each plug is aligned with the second barrel of the jack pair, each plug is not fully insertable into the jack pair because the enlarged portion engages the second barrel and prevents full insertion.

* * * * *